US006523573B2

(12) United States Patent
Robison et al.

(10) Patent No.: US 6,523,573 B2
(45) Date of Patent: Feb. 25, 2003

(54) FLASH TUBE DEVICE

(75) Inventors: Jeffrey C. Robison, Provo, UT (US); Stephen R. Chipman, Provo, UT (US); Michael R. Luque, Orem, UT (US); Craig C. Smith, Provo, UT (US)

(73) Assignee: Caldera Engineering, LC, Provo, UT (US)

( * ) Notice: Subject to any disclaimer, the term of this patent is extended or adjusted under 35 U.S.C. 154(b) by 0 days.

(21) Appl. No.: 09/895,039

(22) Filed: Jun. 29, 2001

(65) Prior Publication Data

US 2002/0069923 A1 Jun. 13, 2002

Related U.S. Application Data

(60) Provisional application No. 60/218,129, filed on Jul. 13, 2000.

(51) Int. Cl.[7] ..... F15D 1/00
(52) U.S. Cl. ..... 138/44; 138/39
(58) Field of Search ..... 138/44, 38, 39; 75/744; 266/168

(56) References Cited

U.S. PATENT DOCUMENTS 3,902,601 A * 9/1975 Townley ..... 138/44
3,986,846 A 10/1976 Bivins, Jr. ..... 48/189.1
4,102,632 A * 7/1978 Hastings ..... 138/38
4,126,743 A 11/1978 Shiomura et al. ..... 528/493
4,441,480 A 4/1984 Rickman et al. ..... 126/42
4,441,925 A * 4/1984 Ishizuka ..... 75/84.5
4,483,892 A * 11/1984 Ohno ..... 428/36
4,644,974 A * 2/1987 Zingg ..... 138/44
4,861,165 A * 8/1989 Fredriksson et al. ..... 138/44
4,964,733 A * 10/1990 Fredriksson et al. ..... 138/44
5,104,233 A * 4/1992 Kojima ..... 138/39
5,592,974 A * 1/1997 Grohs et al. ..... 138/44
5,603,751 A 2/1997 Ackerson ..... 95/268
6,110,255 A * 8/2000 Williams et al. ..... 75/744

* cited by examiner

*Primary Examiner*—James Hook
(74) *Attorney, Agent, or Firm*—Lloyd W. Sadler

(57) ABSTRACT

A new flash tube device adapted specifically for use with hot erosive flow streams is provided. This flash tube uses an extension cone fixed to the outlet of a choke to create an extension choke to insure that the shock wave occurs within the extension choke, thereby decreasing the flow velocity to a subsonic level, reducing the kinetic energy of the flow as it leaves the extension choke. By moving the shock wave into the extension choke, this device dramatically improves the working life of the flash tank, allowing for easier separation of fluid/solids and vapor in the flash tank.

4 Claims, 5 Drawing Sheets

FLASH TUBE DEVICE

CROSS REFERENCE TO RELATED APPLICATIONS

This patent application is based on U.S. Provisional Patent Application No. 60/218,129 filed on Jul. 13, 2000, co-pending at the filing date of this present patent application and priority is hereby claimed thereto.

BACKGROUND OF INVENTION

1. Field of the Invention

This invention relates to saturated fluid/vapor flow control devices for use in controlling a flow stream. More specifically, this invention relates to devices for reducing the velocity of the flow as it leaves the choke 100, thereby improving the working life of system flash tanks and other system components.

2. Description of Related Art

A variety of devices have been proposed for saturated fluid/vapor flow control. Typically, these prior devices result in significantly increased flow momentum as the flow leaves the choke 100 nozzle at high, even supersonic, velocities. This flow momentum increase found in prior devices typically must be dissipated in a flash tank, where significant wear and tear is induced.

SUMMARY OF INVENTION

It is desirable to provide a flow control device, described herein as a Flash Tube Device, which has an enlarged expansion cone to both avoid "explosive" flashing of liquid to vapor as well as reducing the kinetic energy or momentum of the flow, thereby improving the working life of hydraulic components, including the flash tank. While generally within this specification the flow is described as a fluid/vapor mixture it should be understood that this mixture may also include solids. For the purposes of this patent disclosure the flow should be interpreted to include an combination of fluids, vapors and/or solids.

Therefore, it is the general object of this invention to provide a flow control device that has an extended expansion cone to expand the fluid/vapor mixture to a pressure lower than the pressure in the outlet container.

It is a further object of this invention to provide a flow control device that expands the fluid/vapor mixture such that the shock wave occurs within the choke 100.

It is another object of this invention to provide a flow control device that reduces the kinetic energy of the flow as it leaves the choke 100.

A further object of this invention is to provide a flow control device that can be used to match the flow and pressure conditions in the flash tank. A still further object of this invention is to provide a flow control device that can be used to improve the service life of the flash tank and/or allow the flash tank to be made of less expensive materials and/or to be a smaller size.

It is another object of this invention to provide a flow control device that improves the efficiency of fluid (combined with solids if present) and vapor separation in the flash tank by reducing the flow energy in the flash tank.

These and other objects of this invention are achieved by the device described herein and are readily apparent to those of ordinary skill in the art upon review of this disclosure and/or ordinary experimentation with the device described herein.

Reference will now be made in detail to the present preferred embodiment of the invention, an example of which is illustrated in the accompanying drawing.

DETAILED DESCRIPTION

Figure 1A:
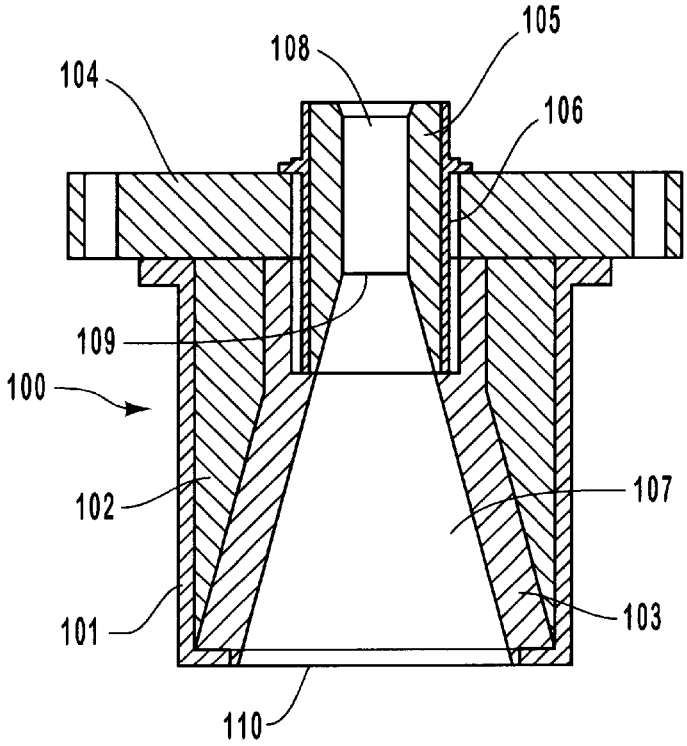
FIG. 1*a* is a section view of the preferred flow control device of this invention.

FIG. 1*a* shows a section view of the preferred flow control device (or choke) 100 of this invention. A blast tube 103 defining an expansion cone 107 is provided within a blast tube holder 101 and mounted to the flash tank lid 104. Holding the blast tube 103 in place is a castable refractory material 102. The expansion cone 107 extends into a ceramic seat housing 106. The inlet 109 of the expansion cone 107 receives flow from an inlet tube 108, which is defined by a ceramic seat 105. The inlet tube 108 works with the expansion cone 107 to expand the steam within the flow to a pressure lower than the pressure in the outlet container (not shown, but typically mounted to the outlet 110 of the expansion cone 107). The steam pressure is lowered thereby sufficiently so that a shock wave occurs within the expansion cone 107 of the choke 100 rather than in a flash tank, which although not shown is typically attached to the outlet 110 of the expansion cone 107. Across this shock wave, the pressure increases and the velocity of the flow through the choke 100 decreases to a subsonic level. With the shock wave formed in the choke 100, the kinetic energy of the flow as it leaves the choke 100 is significantly reduced, permitting a match of not only of the outlet pressure but also the other flow conditions within the flash tank. The location of the shock is determined by the equivalence of the sum of the pressure and momentum flux (see FIG. 9), where the momentum equations are satisfied for both the supersonic conditions and the subsonic conditions matching the outlet pressure. Thus, the flow is supersonic (see FIG. 5) from the choke 100 throat, or inlet tube 108 until it reaches the shock location. The flow then shocks down to a subsonic rate, and exits the choke 100 at the outlet 110 matching the pressure in the flash tank. In the current preferred embodiment, these components of this invention are constructed using machined fit within the interior of the blast tube 101. The blast tube 101 is held to the flash tank lid 104 using mechanical fitting. Similarly, the ceramic seat housing 106 is held to the flash tank lid 104 via a mechanical fit. In the preferred embodiment the blast tube holder 101, the blast tube 103, the ceramic seat housing 106 and the flash tank lid 104 are constructed of tensile strength steel. While the ceramic seat 105 is made from a suitable heat and pressure resistant ceramic. Alternative materials and mechanical configurations are envisioned and can be substituted without departing from the concept of this invention.

Figure 1B:
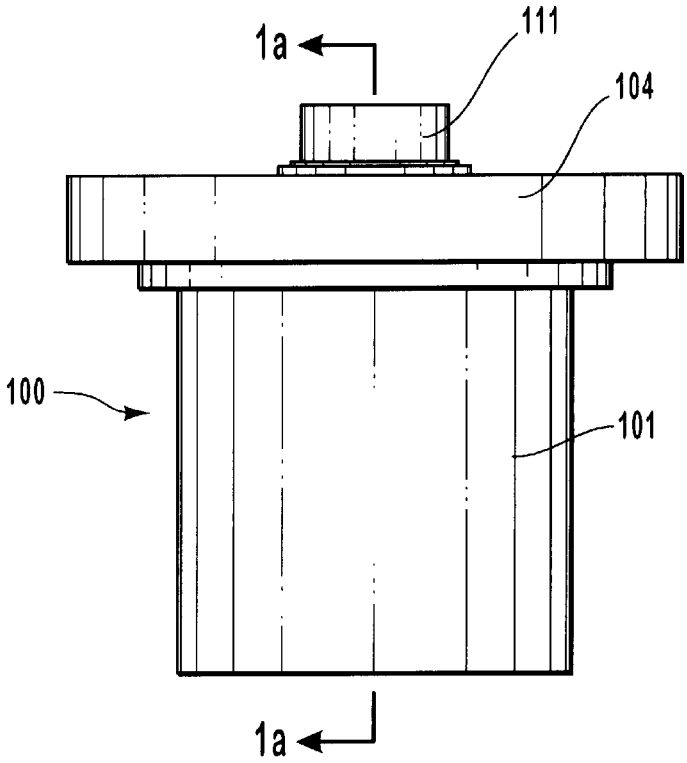
FIG. 1*b* is an exterior view of the preferred flow control device of this invention.

FIG. 1*b* is an exterior view of the preferred flow control device 100 of this invention showing the exterior of the blast tube housing 101. The blast tube housing 101 is shown fixed to the flash tank lid 104. The exit portion 111 of the ceramic seat housing 111 is shown mounted to the flash tank lid 104.

Figure 2:
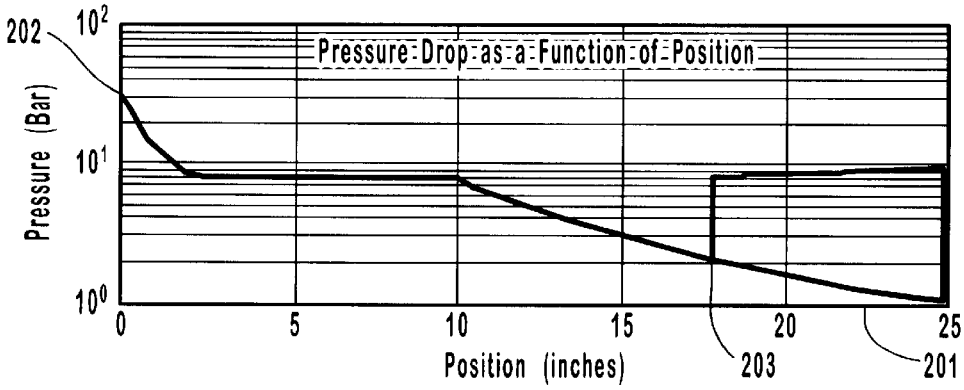
FIG. 2 is a plot of the pressure drop within the choke 100 as a function of choke 100 position using the preferred embodiment of this invention.

FIG. 2 is a plot of the pressure drop within the choke 100 as a function of choke 100 position using the preferred embodiment of this invention. Pressure, in bar, is shown on the Y-axis 202, while position within the choke 100 is shown on the X-axis 201. From this plot it can be seen that in the preferred embodiment of this invention the shock wave occurs at approximately 17 inches from the choke 100 inlet 203.

Figure 3:
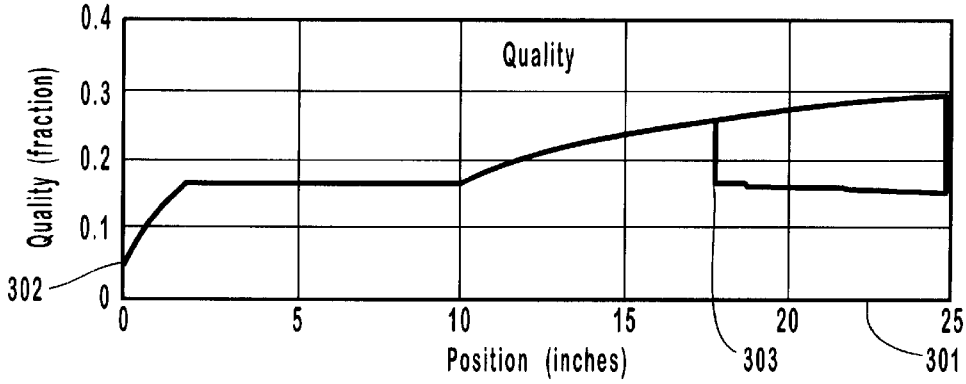
FIG. 3 is a plot of the quality of pressure within the choke 100 as a function of choke 100 position using the preferred embodiment of this invention.

FIG. 3 is a plot of the quality of pressure within the choke 100 as a function of choke 100 position using the preferred embodiment of this invention. Quality (as a fraction) is shown on the Y-axis 302, while position within the choke 100 is shown on the X-axis 301. From this plot it can be seen that in the preferred embodiment of this invention the shock wave occurs at approximately 17 inches from the choke 100 inlet 303.

Figure 4:
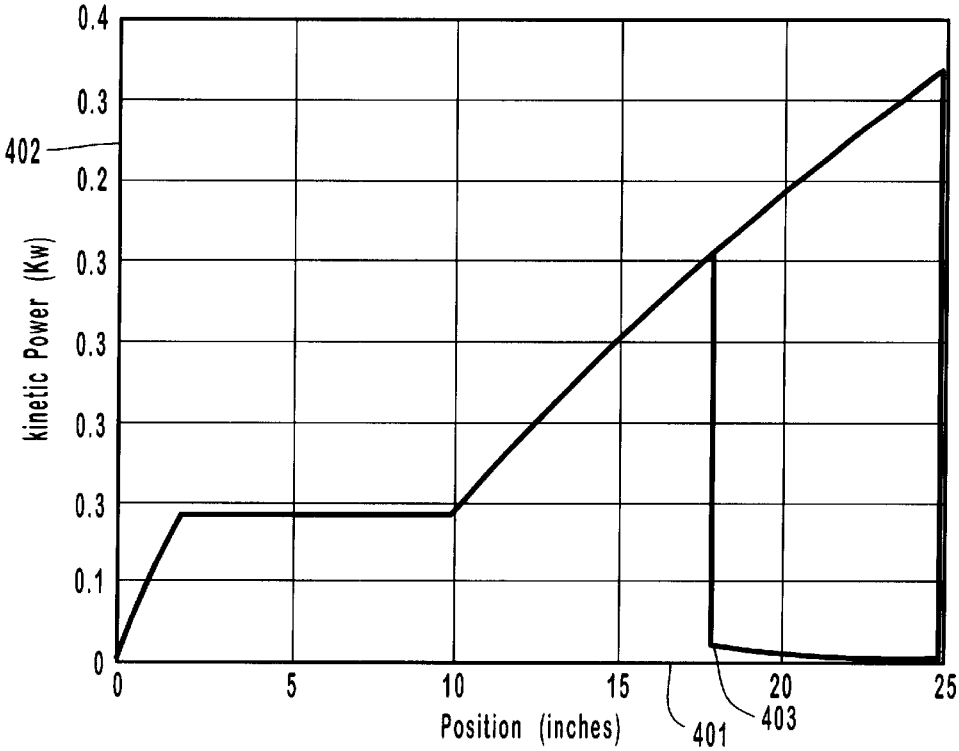
FIG. 4 is a plot of the kinetic power within the choke 100 as a function of the choke 100 position using the preferred embodiment of this invention.

FIG. 4 is a plot of the kinetic power within the choke 100 as a function of the choke 100 position using the preferred embodiment of this invention. Kinetic Power, in KW, is plotted on the Y-axis 402, while position within the choke 100 is shown on the X-axis 401. Again from this plot it can be seen that in the preferred embodiment of this invention the shock wave occurs at approximately 17 inches from the choke 100 inlet 403.

Figure 5:
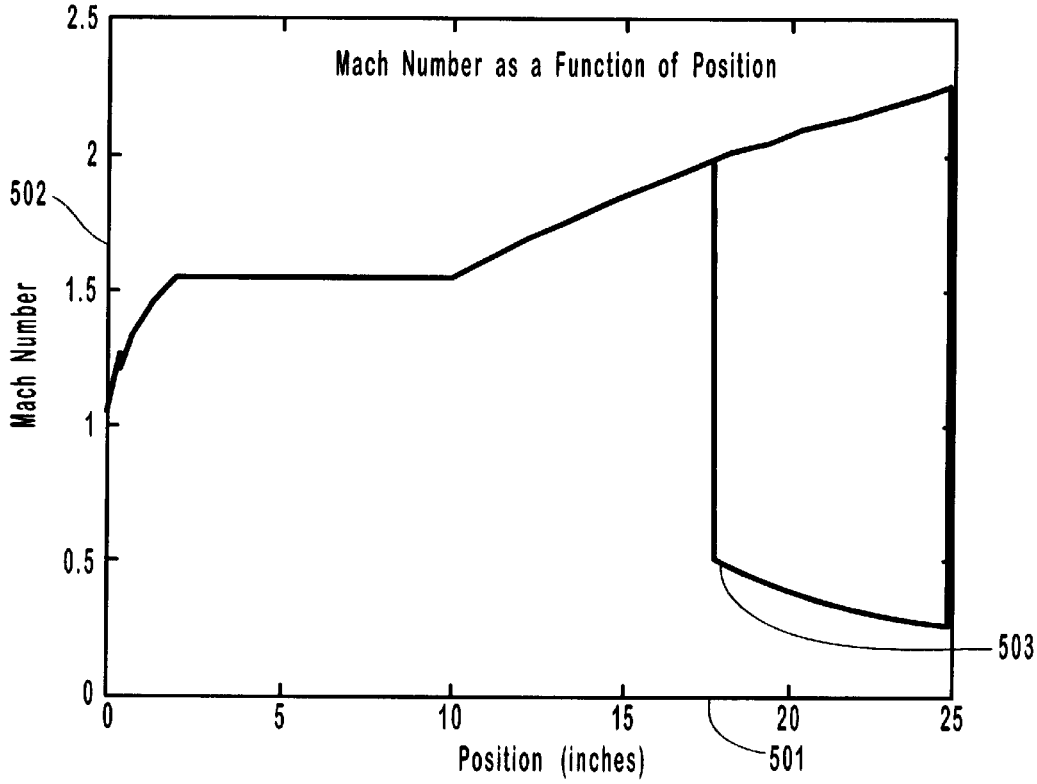
FIG. 5 is a plot of the Mach number of the flow within the choke 100 as a function of the choke 100 position using the preferred embodiment of this invention.

FIG. 5 is a plot of the Mach number of the flow within the choke 100 as a function of the choke 100 position using the preferred embodiment of this invention. The Mach number is plotted on the Y-axis 502, while the position within the choke 1000 is shown on the X-axis 501. Again from this plot it can be seen that in the preferred embodiment of this invention the shock wave occurs at approximately 17 inches from the choke 100 inlet 503.

Figure 6:
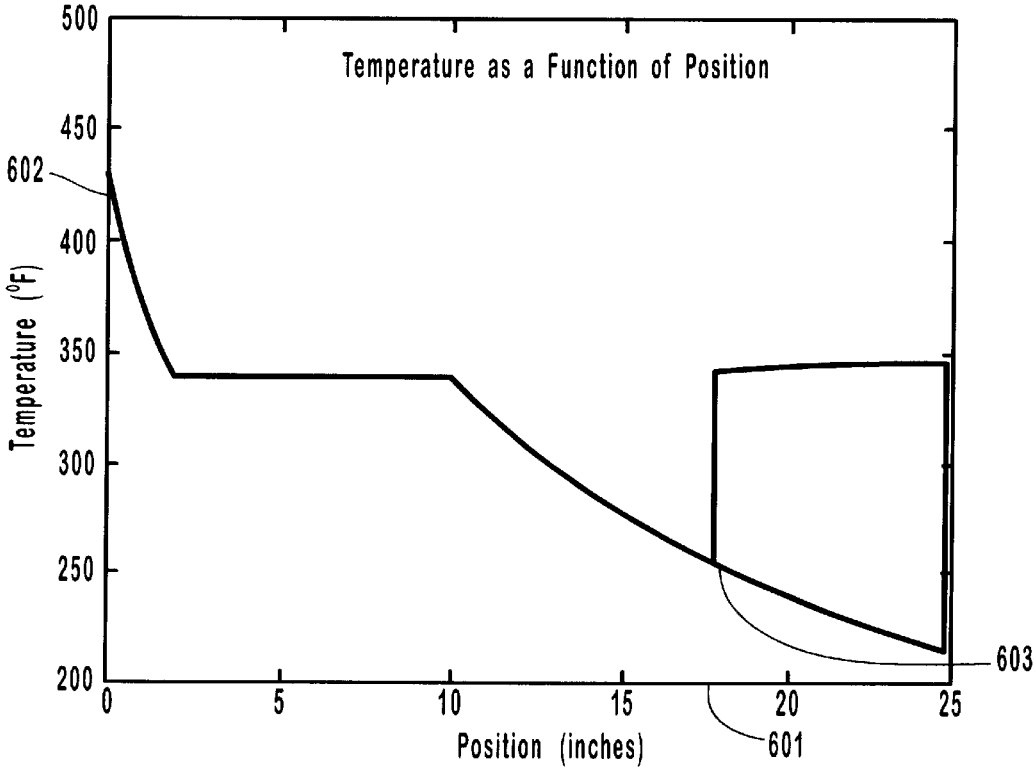
FIG. 6 is a plot of the temperature of the flow within the choke 100 as a function of the choke 100 position using the preferred embodiment of this invention.

FIG. 6 is a plot of the temperature of the flow within the choke 100 as a function of the choke 100 position using the preferred embodiment of this invention. The temperature, in degrees Fahrenheit, is shown on the Y-axis 602, while the position within the choke 1000 is shown on the X-axis 601. Again from this plot it can be seen that in the preferred embodiment of this invention the shock wave occurs at approximately 17 inches from the choke 100 inlet 603.

Figure 7:
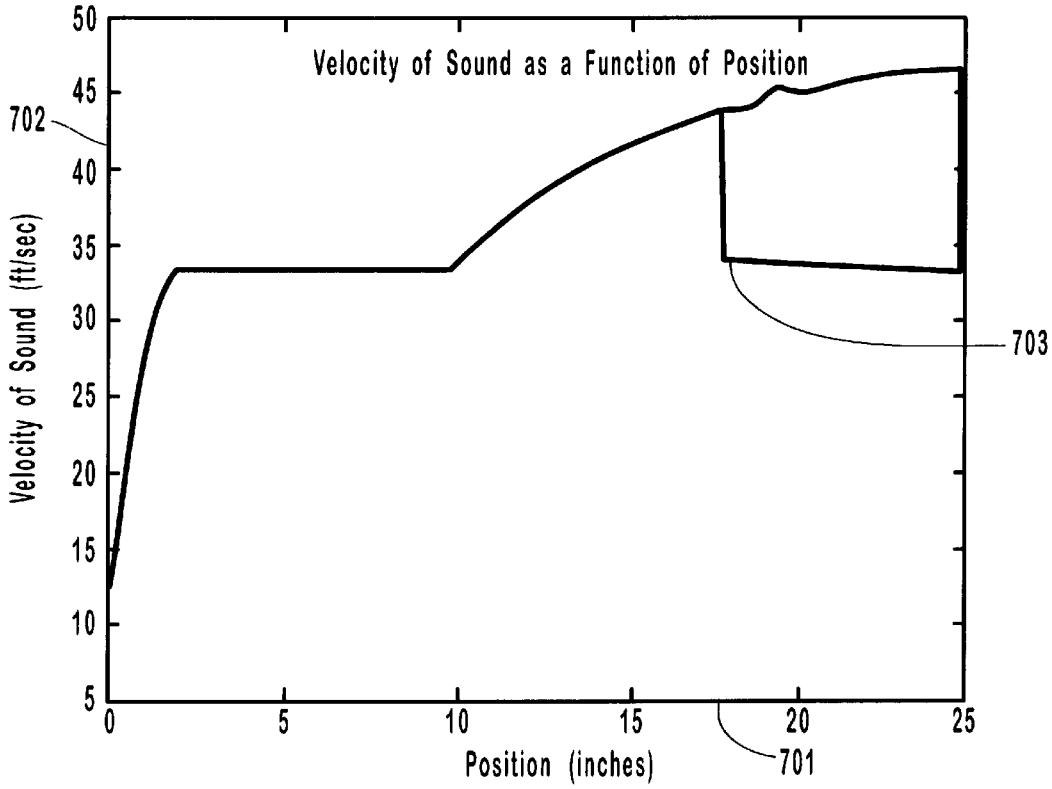
FIG. 7 is a plot of the velocity of sound within the choke 100 as a function of the choke 100 position using the preferred embodiment of this invention.

FIG. 7 is a plot of the velocity of sound within the choke 100 as a function of the choke 100 position using the preferred embodiment of this invention. The velocity of sound within the choke, in feet per second, is shown on the Y-axis 702, while the position within the choke 1000 is shown on the X-axis 701. Again from this plot it can be seen that in the preferred embodiment of this invention the shock wave occurs at approximately 17 inches from the choke 100 inlet 703.

Figure 8:
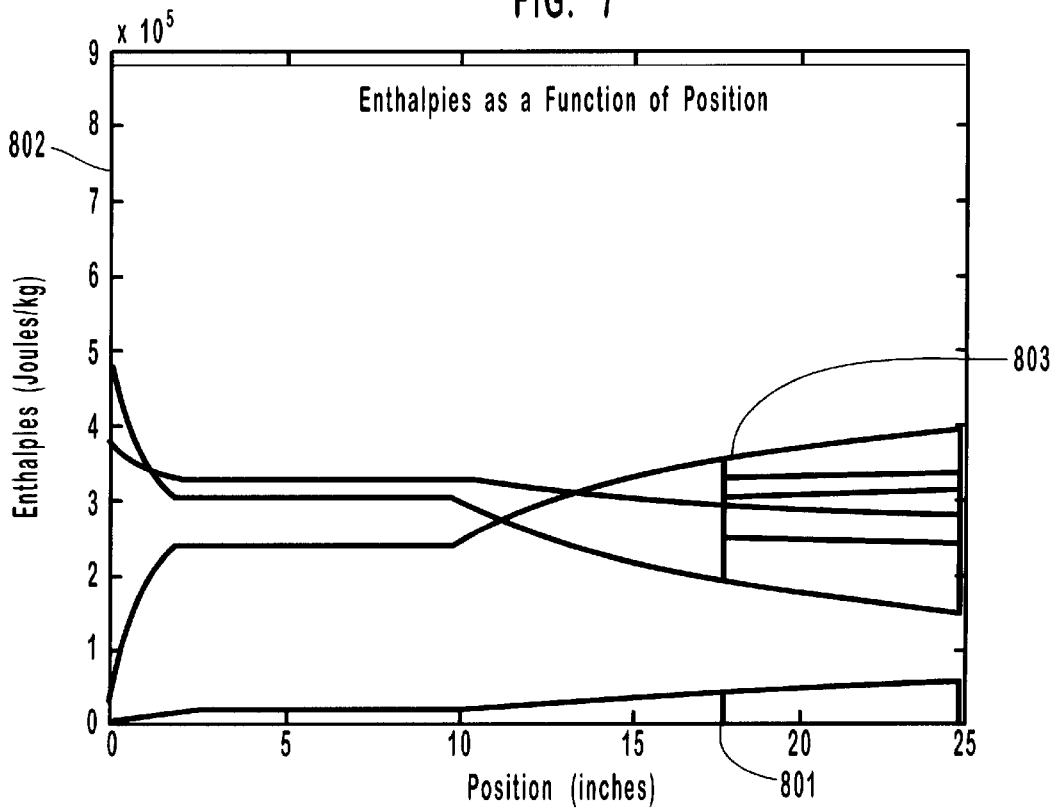
FIG. 8 is a plot of the enthalpies of various constituents in the flow within the choke 100 as a function of the choke 100 position using the preferred embodiment of this invention.

FIG. 8 is a plot of the enthalpies of various constituents in the flow within the choke 100 as a function of the choke 100 position using the preferred embodiment of this invention. The enthalpies, in joules per kilogram, are shown on the Y-axis 802, while the position within the choke 1000 is shown on the X-axis 801. Again from this plot it can be seen that in the preferred embodiment of this invention the shock wave occurs at approximately 17 inches from the choke 100 inlet 803.

Figure 9:
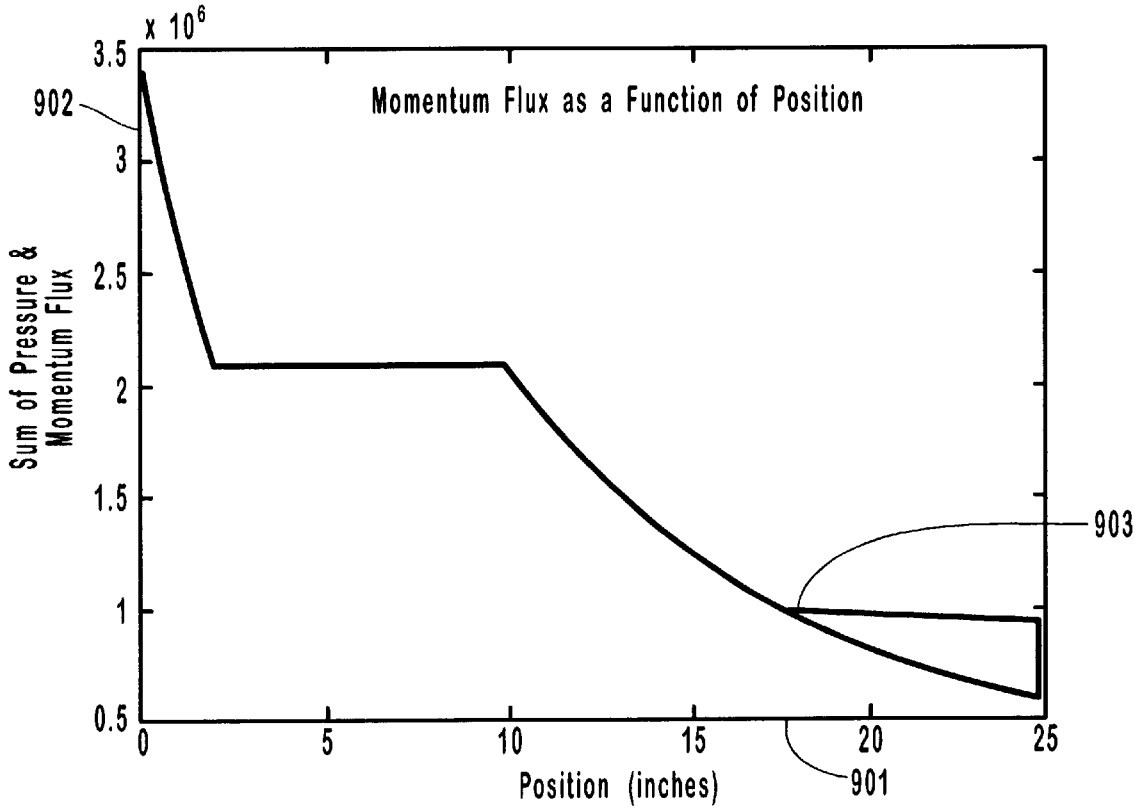
FIG. 9 is a plot of the sum of the pressure and momentum flux within the choke 100 as a function of choke 100 position using the preferred embodiment of this invention.

FIG. 9 is a plot of the pressure plus momentum flux within the choke 100 as a function of choke 100 position using the preferred embodiment of this invention. The momentum flux within the choke 100 is shown on the Y-axis 902, while the position within the choke 100 is shown on the X-axis 901. Again from this plot it can be seen that in the preferred embodiment of this invention the shock wave occurs at approximately 17 inches from the choke 100 inlet 903.

It is to be understood that the above-described embodiment of the invention is merely illustrative of numerous and varied other embodiments, which may constitute applications of the principles of the invention. Such other embodiments may be readily devised by those skilled in the art without departing from the spirit or scope of this invention and it is our intent that they are deemed as within the scope of our invention.

What is claimed is:

1. A flash tube device, comprising:

(A) a blast tube holder;

(B) a refractory material within said blast tube holder;

(C) a blast tube held by said refractory material within said blast tube holder, said blast tube having an inlet end and an outlet end, said blast tube further comprising an expansion cone extending from a ceramic seat housing within an inlet tube to said outlet end of said blast tube, said expansion cone adapted to create a shock wave within said expansion cone when in use; and (D) a flash tank lid fixed to said blast tube holder, through which said extension tube extends to create a flow channel through said blast tube holder.

2. A flash tube device, as recited in claim 1, wherein said refractory material is castable.

3. A flash tube device, as recited in claim 1, further comprising a ceramic seat housing held to said flash tank lid via a mechanical fitting.

4. A flash tube device, as recited in claim 1, wherein said flash tank lid is constructed of tensile strength steel.

* * * * *